US006561372B1

(12) United States Patent
Connolly

(10) Patent No.: US 6,561,372 B1
(45) Date of Patent: May 13, 2003

(54) STORAGE CONTAINER

(76) Inventor: James Patrick Connolly, 26 Watérloo Park, Belfast, BT15 5HU (IE)

( * ) Notice: Subject to any disclaimer, the term of this patent is extended or adjusted under 35 U.S.C. 154(b) by 0 days.

(21) Appl. No.: 09/937,402

(22) PCT Filed: Apr. 4, 2000

(86) PCT No.: PCT/GB00/01260

§ 371 (c)(1),
(2), (4) Date: Sep. 26, 2001

(87) PCT Pub. No.: WO00/59807

PCT Pub. Date: Oct. 12, 2000

(30) Foreign Application Priority Data

Apr. 6, 1999 (IE) ..... S990279

(51) Int. Cl.[7] ..... E04H 4/00
(52) U.S. Cl. ..... 220/9.1; 220/9.2
(58) Field of Search ..... 220/9.1, 9.2, 9.3

(56) References Cited

U.S. PATENT DOCUMENTS 2,378,161 A 6/1945 Sawyer
3,583,748 A * 6/1971 Arndt ..... 220/9.2 X
4,126,905 A 11/1978 Russell et al.
4,356,933 A 11/1982 Connolly
4,691,371 A 9/1987 Derby
4,795,350 A * 1/1989 Rubio ..... 220/9.2 X
5,083,327 A 1/1992 Gillebarrd
5,592,702 A 1/1997 Gillebaard

* cited by examiner

*Primary Examiner*—Steven Pollard
(74) *Attorney, Agent, or Firm*—Nixon & Vanderhye P.C.

(57) ABSTRACT

An improved portable storage container comprises an exterior support frame (1) defining an interior space having an upper periphery and including upright members (3) spaced around the periphery of the interior space and horizontal elongate members (6) disposed about the upper periphery of the interior space, the elongate members (6) each extending along a corresponding side of a polygon. A flexible vessel (2) is arranged within the interior space. The container comprises elastic support means for the upper perimetral portion of the perimetral wall (8) comprising a plurality of strips (10) of elastic material, each extending over a corresponding elongate member (6) of the supporting frame (1), a first end portion (11) of each strip (10) being bonded in a first region of bonding to an inner face of the perimetral wall (8), and a second end portion (12) being bonded in a second region of bonding to an outer face of perimetral wall (8).

24 Claims, 3 Drawing Sheets

STORAGE CONTAINER

This invention relates to a storage container for a liquid or granular solid.

It is often expedient to store liquids or flowable solids, particularly pulverulent or granular solids, in temporary storage containers. Thus, when a large scale fire occurs in a location remote from a mains water supply, for example, in the event of a forest fire, temporary storage may be required for water to be used in fighting the fire. Also in case of oil spillage in a river or in coastal waters, there may be a need to provide storage for oil and tarry residues that have been recovered from the spillage. In the event of famine emergencies, as in case of prolonged drought in remote regions, there may be a need to provide temporary storage for drinking water or for food, such as grain, for distribution to the local populace. In all such cases requirements for such a storage container are that it shall be collapsible, that it shall be readily portable, that it shall be easily transportable by air, that it shall be capable of swift assembly by possibly unskilled persons, and that it shall be safe in use.

Figure 3:
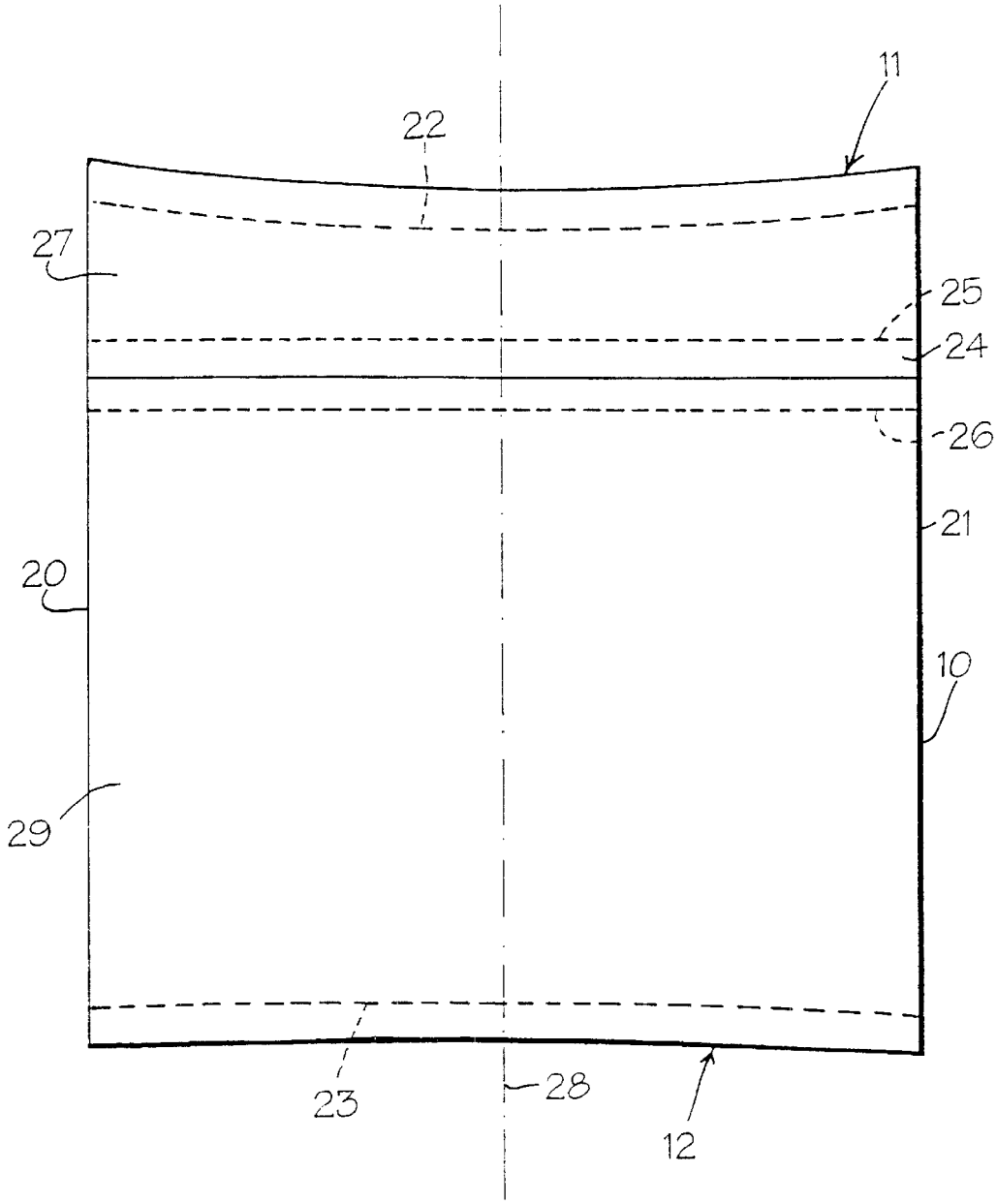

An example of a suitable temporary storage container of this type is described in British Patent Specification No. 1586767 and Irish Patent Specification No. 49888. This describes a static tank or container for holding a fluent material and having a limp flexible bottom resting on a flat surface and form which upstands a limp flexible perimetral wall circular in plan. The container is maintained upstanding by flexible support means connected between the upper edge thereof and an upper horizontally disposed continuous member of a framework surrounding the perimetral wall. The perimetral wall is formed of waterproof-coated woven fabric of synthetic material with the warp of the fabric running lengthwise around the wall and the weft thereof being upright. The synthetic material has a strength to weight ratio and a stretch characteristic sufficient that the wall requires no internal reinforcement or external support against outward pressure from contents when filled into the tank or container. Five different forms of support are illustrated in FIG. 3 of British Patent Specification No. 1586767, U.S. Pat. No. 4,356,933 and of Irish Patent Specification No. 49888; three of these involve elastic straps, and one involves helical springs. The remaining type involves a resilient sheet looped around the upper horizontally disposed continuous member of the supporting framework between the junctions of two adjacent vertical rods forming part of the framework with the member, the opposed sides of the sheet being secured by adhesive or welding to the upper end of the perimetral wall.

Containers of this type in which the flexible support means comprises a plurality of elastic straps have been widely sold for use by aid agencies, by fire-fighting services, and by environmental protection services in many countries of the world. Such containers are available under the trade mark FASTANK® from Fast Engineering Limited of Old Mill Industrial Estate, Antrim, Northern Ireland BT41 4QE. The disassembled support structure and flexible container can be packed for transport and between periods of use in elongate boxes with carrying handles at each end which can easily be carried by two persons.

When such containers are used for storage of oils and tarry materials, for example, during clearing up operation after an oil spillage, there is a need after use to clean the tanks before they are packed away in readiness for re-use at another site. This is a time-consuming and somewhat tedious task because each of the flexible straps has to be disconnected from the container, cleaned separately and then re-assembled. In addition such containers comprise a multiplicity of parts, a factor which adds to its cost of manufacture. Some of the metal parts are curved or bent, a further factor which adds to the complexity of manufacture and the cost of the container.

It would be desirable to provide an improved form of storage container.

The present invention accordingly seeks to provide an improved portable storage container which is simpler in construction than prior art commercial forms of portable storage containers. It further seeks to provide an improved portable storage container having a flexible inner vessel which has a simpler form of suspension from an outer framework than commercial prior art portable storage containers. Another aim of the invention is to provide a portable storage container which is simpler to manufacture than prior art containers of this type. In addition the invention seeks to provide a storage container in which the use of curved or bent members can be substantially avoided, thereby simplifying both manufacture of such containers and also packing of such containers in storage boxes therefor. Still further it seeks to provide an improved portable storage container which can be quickly and more readily cleaned than existing commercial forms of portable storage containers, for example after use thereof for storage of oil or tarry residues.

According to the present invention there is provided a portable storage container comprising:

an exterior support frame defining an interior space having an upper periphery and including a plurality of upright members spaced from one another around the periphery of the interior space and a plurality of substantially horizontal elongate members disposed about the upper periphery of the interior space, the elongate members each extending along a corresponding side of a polygon;

a flexible vessel within the interior space having a bottom wall and an upstanding flexible perimetral wall secured to the bottom wall; and elastic support means for the upper perimetral portion of the perimetral wall comprising a plurality of strips of elastic material, each of which extends over a corresponding elongate member of the supporting frame, a first end portion of each strip being bonded in a first region of bonding to an inner face of the perimetral wall, and a second end portion being bonded in a second region of bonding to an outer face of perimetral wall.

Each of said strips may include a first web portion extending freely from the upper rim of the flexible upstanding perimetral wall to the corresponding substantially horizontal elongate member, and a second web portion extending freely from the corresponding substantially horizontal member to the second region of bonding, the second web portion being longer than the first web portion. Thus the first web portion and the second web portion may subtend an included angle in a vertical plane of from about 15° to about 30°. Preferably the second web portion is at least twice the length of the first web portion.

In one arrangement the bottom wall of the flexible vessel is substantially circular in plan.

The inner vessel can be provided with a plurality of tabs for facilitating flattening of the bottom wall in the empty condition of the inner vessel. If desired, each tab can be provided with an aperture for passage of a ground penetrating peg or for facilitating securement to one of the upright members.

In a preferred design the framework is substantially hexagonal in plan. According to an alternative design the framework is substantially octagonal in plan.

The first end portion preferably extends to a first arcuate concave edge of said strip and the second end portion extends to a second arcuate concave edge of said strip, the radius of curvature of the second concave edge being less than that of the first arcuate concave edge.

Conveniently the substantially horizontal elongate members comprise open ended members or male-ended members and the upright members are each provided with corresponding stub arms, each adapted to be snugly received within a corresponding open ended member or formed with a female socket for snug receipt of a corresponding male end of a male-ended member. In such a portable storage container the exterior support frame can further include a plurality of lower cross bars, each of which extends between an adjacent pair of upright members at a height of from about one quarter to about one half of the way up the height of the upright members. Typically such lower cross bars each extend between an adjacent pair of upright members at a height of about one third of the way up the height of the upright members. Conveniently the lower cross bars comprise open ended or male-ended members and in which the upright members are each provided with corresponding stub arms, each adapted to be snugly received within a corresponding open ended member or formed with a female socket for snug receipt of a corresponding male end of a male-ended member. The members forming the upper elongate members or the lower cross bars can be secured to corresponding stub arms by means of retaining pins, for example captive pins, adapted for reception in corresponding aligned bores in the stub arms and in the upper elongate members or cross bars. The open ended members can comprise hollow box section members.

The attachment of the second end portion of each strip to the outer face of the perimetral wall is preferably provided with reinforcement means, such as a separate gusset of flexible material folded into a V-shape, one arm of the V-shape being secured to the inner face of the strip and the other end being secured to the outer face of the perimetral wall.

The flexible perimetral wall has an upper rim and, in one arrangement comprises a lower perimetral portion secured to the bottom wall and extending up from the bottom, a medial perimetral portion above the lower perimetral portion, and an upper perimetral portion above the medial perimetral portion, the upper perimetral portion extending less than one quarter of the height of the perimetral wall down from the upper rim of the perimetral wall, while the lower perimetral portion extending no more than one quarter of the height of the perimetral wall up from the bottom wall. In this case the end of each strip that is bonded to the inner face of the perimetral wall is bonded to the upper perimetral portion thereof, while the other end of that strip is bonded to the outer face of the perimetral wall on the medial perimetral portion thereof.

Figure 1:
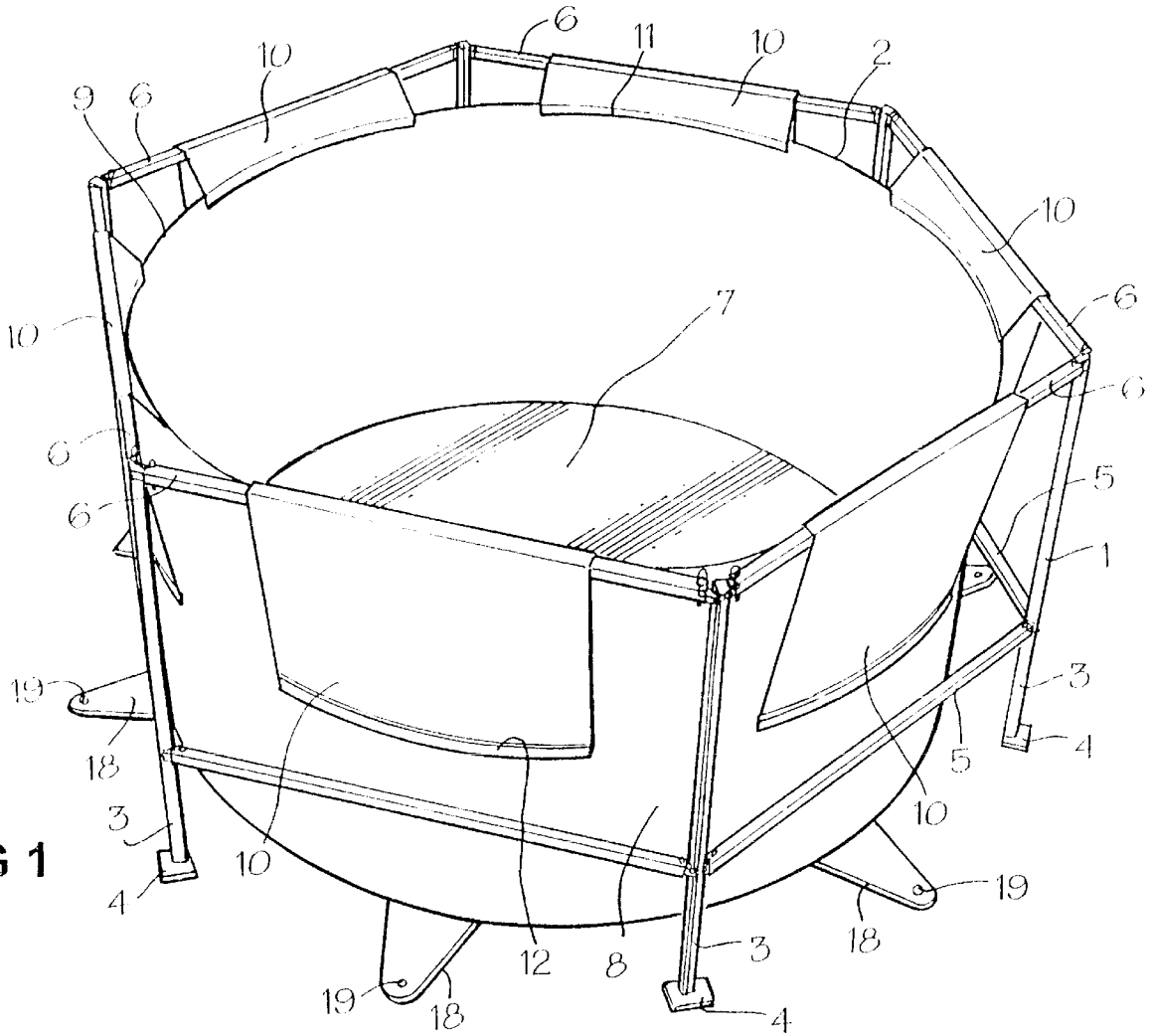
Figure 2:
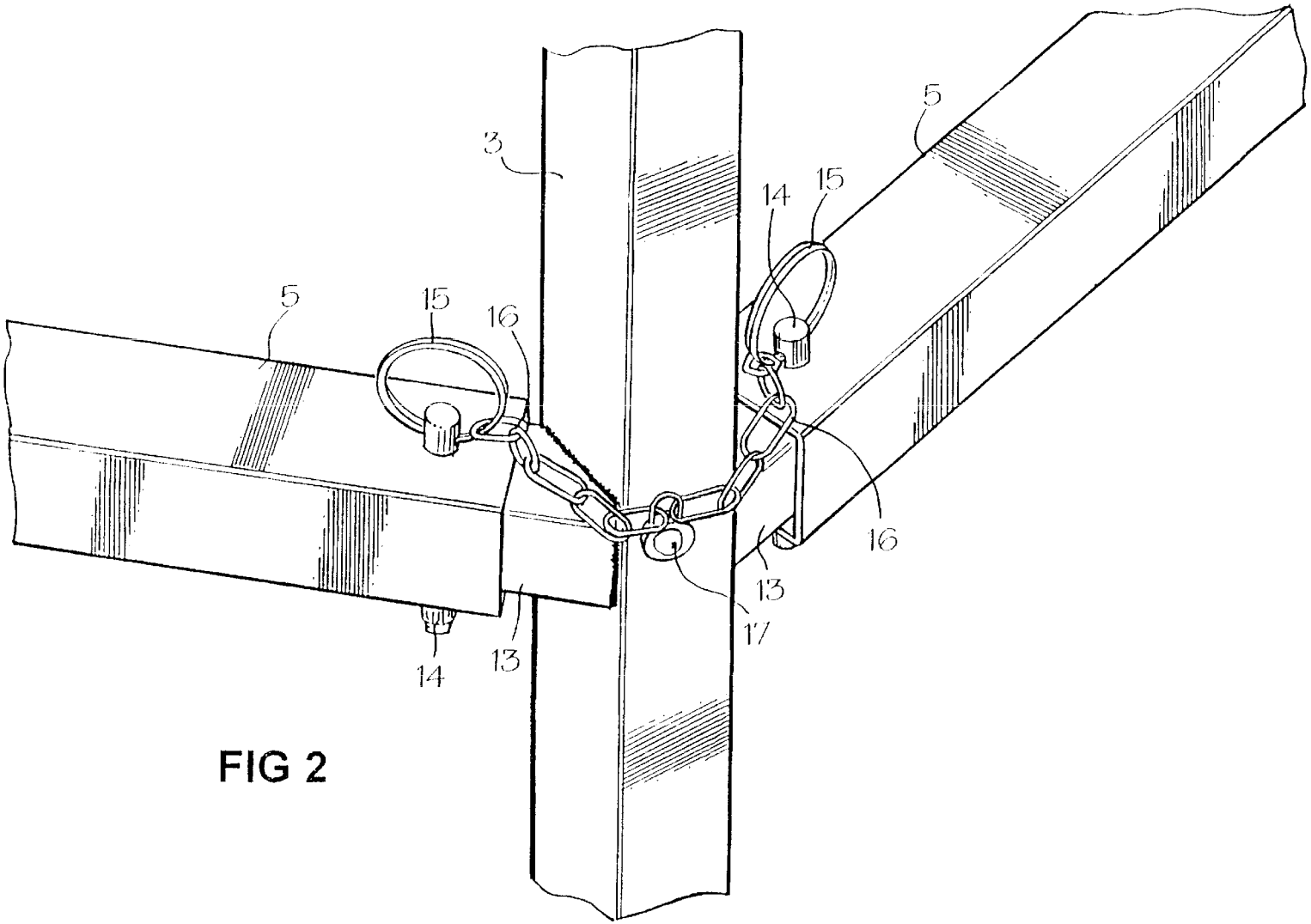

In order that the invention may be clearly understood and readily carried into effect a preferred embodiment thereof will now be described, by way of example only, with reference to the accompanying drawings wherein:

FIG. 1 is a perspective view of a portable storage container constructed in accordance with the invention;

FIG. 2 is a detail view on an enlarged scale showing the method of attachment of a lower cross bar to a leg of the supporting frame of the storage container of FIG. 1; and FIG. 3 is a plan view of one of the strips of flexible material used to form the support means for supporting the flexible inner container on the upper cross bars of the supporting frame of the portable storage container of FIG. 1.

Referring to the drawings and to FIG. 1 in particular, a portable storage container comprises an outer supporting frame 1 and an inner flexible vessel 2. Outer supporting frame 1 comprises a series of upright legs 3, each provided with a foot 4, a series of lower cross bars 5 and a series of upper elongate members 6. Cross bars 5 and upper elongate members 6 are each supported substantially horizontally by legs 3 and the framework 1 thus formed defines an interior space which is substantially polygonal, e.g. hexagonal, in plan and whose upper periphery is defined by the upper elongate members 6. Lower cross bars 5 are typically connected (as will be described in more detail below) to upright legs 3 at a point between about one quarter and about one half of the way up upright legs 3, preferably at about one third of the way up legs 3. The upper edge of the flexible inner vessel 2 is supported within this space. In the framework 1 upright legs 3 are preferably disposed substantially vertically, although it is alternatively possible to arrange for them to lean either slightly inwards or outwards, for example at an angle of no more than about 10°, e.g. about 5°, to the vertical, to improve the stability of framework 1.

Flexible inner vessel 2 is formed from a waterproof-coated woven fabric and comprises a bottom wall 7, which is circular in plan, and an upstanding perimetral wall 8 which is secured at its lower end to the periphery of the bottom wall 7. The upper rim 9 of the perimetral wall 8 is supported in the empty condition of the flexible vessel 2 by means of a series of wide strips 10 of elastic material, a first end 11 of each of which is attached to an inner face of the perimetral wall 8 of flexible inner vessel 2 near the upper edge thereof. The end 11 terminates just below the upper rim of vessel 2 in an upper perimetral portion of the perimetral wall 8. Thus each strip 10 typically extends from the upper rim 9 downwards a distance on the inner face of inner flexible vessel 2 a distance corresponding to no more than about 25% of the way down the height of the perimetral wall 8 from the upper rim 9 thereof. Preferably that distance is no more than about 5% to 10% of the way down the height of the perimetral wall 8.

Each strip 10 extends lengthwise upward and outward so as to form a loop over a corresponding upper elongate member 6, its other end 12 being attached to the outer face of the perimetral wall 8 of the inner vessel 2 approximately half way up the height thereof in a medial perimetral portion of the perimetral wall 8 which extends from the upper perimetral portion down to a lower perimetral portion of the perimetral wall 8. That lower perimetral portion extends up from the bottom wall 7 no more than about one quarter of the way up the perimetral wall 8 from the bottom wall 7, typically about 10% to about 25% of the way up the perimetral wall 8 from the bottom wall 7. By means of this arrangement the upper rim 9 is supported during filling of the inner vessel 2 with water or oil without the weight of the contents of the flexible inner vessel 2 during or after filling causing undue strain upon the strips 10.

FIG. 2, which is drawn to an enlarged scale, shows the method of attachment of a pair of adjacent cross bars 5 to a leg 3. Each leg 3 and cross bar 5 is a hollow square section metal member made, for example, of aluminium or mild steel. A pair of stub arms 13, each of which is a snug fit in the end of a corresponding cross bar 5, is welded to each leg 3. The stub arms 13 on a particular leg 3 subtend an angle of 120° one with another in plan. Captive retainer pins 14 are used to lock each cross bar 5 to its corresponding stub arm 13. These retainer pins 14 are passed through corresponding apertures drilled in the stub arms 13 and cross bars 5. Each retainer pin 14 carries a ring 15 at one end which is connected by means of a length of chain 16 to a screw 17 secured to the corresponding leg 3.

A similar arrangement is used to secure the upper elongate members 6 to the top ends of legs 3. Thus further stub arms are welded to the upper ends of legs 3, these further stub arms each being designed to fit inside a corresponding open end of an upper elongate member 6.

Reverting to FIG. 1, tabs 18 are secured to the bottom wall 7 of the inner vessel 2. Each tab 18 has an aperture 19 so as to provide a corresponding anchorage point for the inner vessel 2 before it is filled. Pegs (not shown) can be driven through apertures 19 into the subjacent ground for this purpose.

Alternatively tabs 18 can be positioned so that they can be captured by or under the feet 4.

FIG. 3 illustrates one of the strips 10 in flattened condition and on an enlarged scale in more detail. As can be clearly seen, end edge 11 which is secured to the inner face of the inner vessel 2 is curved so as to be concave. So also is the opposite end edge 12, although the radius of curvature of end edge 12 is larger than that of end edge 11. The side edges 20 and 21 are substantially parallel to one another. Line 22 indicates the limit of a first region of bonding which extends to the end edge 11. In this first region of bonding an end portion of strip 10 is welded to the inner face of the perimetral wall 8, while line 23 indicates the upper end of a second region of bonding in which the other end of strip 10 is welded to the outer face of the perimetral wall 8. These regions of bonding serve to secure the strip 10 to the inner vessel 2. As already pointed out above, the first region of bonding is located on the inner face of an upper perimetral portion of the perimetral wall 8 while the second region of bonding is located on the outer face of the medial perimetral portion of the perimetral wall 8. The area 24 between lines 25 and 26 can be reinforced by means of a second piece of flexible material welded to strip 10 so as to increase the strength of the strip 10 where it passes over the corresponding upper elongate member 6.

The perimetral wall 8 of inner vessel 2 can be constructed, for example, from a suitably coated high tenacity polyester fabric constructed from warp threads that stretch less than the weft threads thereof. Such a fabric can be coated with polyvinyl chloride, with polyurethane, or with rubber. The fabric is used in the construction of the inner vessel 2 such that the high tenacity warp threads extend in the perimetral direction and bear the hoop tension with minimal stretching, while the weft threads extend from top to bottom of the perimetral wall. A suitable lap joint (not shown) is formed by stitching and/or gluing and/or welding so as to complete a watertight perimetral wall 8. Such a lap joint preferably extends substantially vertically in the erected condition of the container 1.

Strips 10 are made from an elastic material, preferably a coated woven fabric whose warp threads are less elastic than its weft threads. A typical material is a high tenacity coated nylon or polyester fabric which, when tested in accordance with British Standard 3424 M.6, has the following characteristics:

Tensile strength in warp/weft direction:
2500/2250 N/50 mm

Tensile elongation at break in warp/weft direction:
30/39%

The material should be used so that the weft threads extend from end 11 to end 12 of each strip 10, while the warp threads extend from one edge 20 thereof to the other edge 21. Typical coatings include polyvinyl chloride, polyurethane, and rubber. Any coating on the material of strips 10 is preferably selected so as to facilitate welding or glueing of strips 10 to the material of inner vessel 2.

Inner vessel 2 is typically made from a coated woven fabric such as a high tenacity coated nylon or polyester fabric which, when tested in accordance with British Standard 3424 M.6, has the following characteristics:

Tensile strength in warp/weft direction:
4300/4000 N/50 mm

Tensile elongation at break in warp/weft direction:
15/25%

Generally speaking, the material of strips 10 is lighter per unit area and more elastic than that of the inner vessel 2 so as to allow the strips 10 to flex and extend in preference to the wall of inner vessel 2.

The bottom 7 of the inner vessel 2 need not be reinforced because it is supported on the ground or other subjacent substantially horizontal surface. The bottom wall 7 is welded to the perimetral wall 8 using a weld that is typically at least 1 inch (2.54 cm) wide on the outside of the lower perimetral portion of the perimetral wall 8.

In the case of the weld between the strip 10 and the outer face of the perimetral wall 8 at the end 12 of the strip 10, an additional reinforcement can be provided in the form of a separate reinforcing gusset in the form of a further strip of flexible material (not shown) folded into a V-shape, one arm of the V-shape being welded to the inner face of the strip 10 above the line 23 and the other arm of the V-shape being welded to the outer face of the perimetral wall 8 above the line 23.

In a typical arrangement the diameter of inner vessel 2 and its overall height are so selected in relation to the dimensions of the outer framework, and in particular in relation to the spatial relationship between the upper rim 9 of inner vessel 2 and the upper elongate members 6, that a first web portion 27 of strip 10 that extends freely up from the rim 9 to elongate member 6 subtends an included angle along its mid vertical axis 28 of from about 15° to about 30° with a second web portion 29 that extends freely from the elongate member 6 to the second region of bonding. Thus, for example, first web portion 27 can make an angle of 45° to the horizontal while second web portion 29 makes an angle of 65° to the horizontal in the erected condition of the illustrated portable storage container. Second web portion 29 is longer than first web portion 27, typically being at least twice as long, and possibly three to five times as long, as first web portion 27.

The second web portion 29 is sufficiently long to allow extension by elastic stretching of the strip 10 to accommodate the tank 1 on sloping or uneven ground without putting full load on the upper elongate members 6. Hence strips 10 act an a safety feature which prevents stress concentrations and elastically redistributes load, thus providing load shed to less stressed parts of the structure. Moreover the strips 10, when extended elastically, allow the upper rim 9 to lower in elevation and gently spill liquid or other load from the inner vessel 2, thus relieving load on the structure and re-establishing stresses to a safe level within the design parameters.

When one strip 10 extends, this forces adjacent strips 10 to start sharing the load, again safely re-distributing the load in the fabric of inner vessel 2 and the supporting metal frame.

Cross bars 5 and upper elongate members 6 are preferably so sized in relation to the stub arms 13 that a limited amount of angular movement of each cross bar 5 or upper elongate member 6 on each corresponding stub arm 13 is possible. For example, there may be between about 1° and about 5°, e.g. about 2°, of angular movement possible at each stub arm 13. This limited angular movement allows the framework 1 to adapt to unevenness of the underlying ground.

The embodiment of FIGS. 1 to 3 is hexagonal in plan and can accommodate 5 tonnes of liquid. For larger quantities of liquid, for example 7.5 tonnes, it may be more expedient to utilise a framework 1 that has more than 6 sides, for example a framework that is octagonal in plan. In this case the angle in plan between the stub arms 13 would be correspondingly increased; in the case of a framework that is octagonal in plan this angle would be increased to 135°.

In other embodiments the framework may in plan have a smaller number of sides, e.g. 4 or 5, or a larger number of sides, e.g. 7, 9 or 10.

In an alternative construction each pair of stub arms 13 can be formed in moulded plastics material or in metal integrally with a sleeve piece which is a snug fit on leg 3 and is secured thereto by means of a rivet or through bolt.

It is also envisaged that the cross bars 5 and/or upper elongate members 6 can be formed as pultrusions; in other words these parts of the structure could be extruded resin/plastics and fibre sections.

In a variant of the illustrated design, cross bars 5 and/or upper elongate members 6 are formed as rectangular section members, or as circular section members, or as elliptical section members, or as members of a different cross section than any of these, instead of as square section members.

When the illustrated portable storage container is not in use, it will normally be convenient to disassemble it and pack the legs 3, the members 5 and 6, and the folded inner vessel 2 in an elongate storage box (not shown) whose interior length is slightly longer than the longest dimension of any of the legs 3 and members 5 and 6. In this form a number of the portable storage containers can be stacked in a warehouse or on the ground or for transportation.

To assemble the illustrated portable storage container it is a simple matter first to connect the lower members 5 to the stub arms 13 using the securing pins 14 thereby forming a hexagonal enclosure and then to slip each upper elongate member 6 under its strip 10 before securing this in place using its corresponding securing pin until the framework 1 has been completed with the inner vessel 2 hanging in place inside the space defined by the framework 1. During this erection procedure the joints between lower members 5 and stub arms 13 can articulate to accept unevenness or sloping character of the underlying ground. Then the bottom wall 7 can be stretched out until it is lying substantially flat on the subjacent ground, whereupon tent pegs or similar pegs can be driven home through apertures 19 into the subjacent ground in order to keep the bottom wall 7 in flattened condition during filling of the tank with water or other liquid or granular solid. Alternatively tabs 18, if appropriately repositioned in relation to strips 10, can be captured under feet 4.

During and after filling the illustrated design serves to minimise the risk of imposing a load with a high vertical component on the perimetral wall 8.

Once the illustrated portable storage container has been erected, it can be filled with liquid or with a granular solid, such as wheat, corn or other edible grain. As flexible inner vessel 2 is filled so its perimetral wall 8 will tend to flex outwardly and contact the lower cross bars 5. To enable this to occur the diameter of the flexible inner vessel 2 is selected in relation to the interior dimensions of the outer support frame 1 so that, during filling of the flexible inner vessel 2, the internal pressure in the flexible inner vessel 2 due to the contents of the flexible inner vessel 2 causes the upstanding perimetral wall 8 to move outwards and abut against the lower cross bars 5 thereby to stiffen the support frame 1 and render it essentially rigid while filling continues and after the vessel has been entirely filled. Thus, after filling the portable storage container, the weight of the contents of the flexible inner vessel 2 serves to stiffen the supporting framework 1 by bearing on the lower cross bars 5.

If a dirty material, such as crude oil or a crude oil/water mixture from a spillage, is loaded into the container, then the operative responsible for filling inner vessel 2 will naturally tend to position the inlet pipe used to fill the container, where it crosses the upper rim 9 of inner vessel 2, over one of the strips 10. Hence any soiling of the upper rim 9 tends to be confined to the surface of the strip 10, a feature which facilitates eventual cleaning of the vessel 2. It is not necessary to dismantle the container prior to cleaning.

As illustrated in FIG. 3, strips 10 have curved concave end edges 11 and 12. However it is alternatively possible to utilise strips 10 with at least one of the edges 11 and 12 being cut straight rather than as concave curves. Both of edges 11 and 12 can be cut straight, if desired.

Cross bars 5 and elongate members 6 are described above as being open ended, i.e. female in form, while the corresponding stub arms (e.g. stub arms 13) are male in form. It is alternatively possible to utilise solid or hollow male-ended cross bars 5 and/or elongate members 6, in which case the corresponding stub arms, such as stub arms 13, are replaced by socket members of female form, appropriately sized to receive a male end of a cross bar 5 or elongate member 6 in a similar fashion to that illustrated in FIGS. 1 and 2. In this way the articulations between the upright members 3, the cross bars 5 and the elongate members 6 permit a limited amount of movement relative to one another thereby to accommodate unevenness of the ground or other support surface upon which the portable storage container is erected, at least until the flexible vessel 2 is filled. Retaining pins, corresponding to retaining pins 14, are conveniently used to secure the cross bars 5, elongate members 6, and upright members 3 one to another.

What is claimed is:

1. A portable storage container comprising:

an exterior support frame (1) defining an interior space having an upper periphery and including a plurality of upright members (3) spaced from one another around the periphery of the interior space and a plurality of substantially horizontal elongate members (6) disposed about the upper periphery of the interior space, the elongate members (6) each extending along a corresponding side of a polygon;

a flexible vessel (2) within the interior space having a bottom wall (7) and an upstanding flexible perimetral wall (8) secured to the bottom wall (7), wherein the upstanding flexible perimetral wall (8) is made of a coated woven fabric comprising warp and weft threads, wherein the warp threads of the coated woven fabric of the flexible perimetral wall (8) stretch less than the weft threads thereof, wherein the warp threads of the coated woven fabric of the flexible perimetral wall (8) extend in the perimetral direction thereof and bear the hoop tension with minimal stretching, and wherein the weft threads of the coated woven fabric of the flexible perimetral wall (8) extend from top to bottom of the flexible perimetral wall (8); and elastic support means for the upper perimetral portion of the perimetral wall (8) comprising a plurality of strips (10) of elastic material, each of which extends over a corresponding elongate member (6) of the supporting frame (1), a first end portion (11) of each strip (10) being bonded in a first region of bonding to an inner face of the perimetral wall (8), and a second end portion (12) being bonded in a second region of bonding to an outer face of the perimetral wall (8), wherein each of said strips (10) includes a first web portion extending freely from the upper rim (9) of the flexible upstanding perimetral wall (8) to the corresponding substantially horizontal elongate member (6), and a second web portion extending freely from the corresponding substantially horizontal member (6) to the second region of bonding, the second web portion being longer than the first web portion, wherein the elastic material of the strips (10) comprises a coated woven fabric comprising warp and weft threads, wherein the warp threads of the coated woven fabric of each strip (10) are less elastic than the weft threads thereof, wherein the warp threads of the coated woven fabric of each strip (10) extend from one end to the other end thereof, and wherein the weft threads of the coated woven fabric of each strip (10) extend from one side (20) of the strip (10) to the other side (21) thereof.

2. A portable storage container according to claim 1, in which the first web portion and the second web portion subtend an included angle in a vertical plane of about 15° to about 30°.

3. A portable storage container according to claim 1, in which the second web portion is at least twice the length of the first web portion.

4. A portable storage container according to claim 1, in which the bottom wall (7) of the flexible vessel (2) is substantially circular in plan.

5. A portable container according to claim 1, in which the inner vessel (2) is provided with a plurality of tabs (18) for facilitating flattening of the bottom wall (7) in the empty condition of the inner vessel (2).

6. A portable storage container according to claim 5, in which each tab (18) is provided with an aperture (19) for passage of a ground penetrating peg or for facilitating securement to one of the upright members (3).

7. A portable storage container according to claim 1, in which the framework (1) is substantially hexagonal in plan.

8. A portable storage container according to claim 1, in which the framework (1) is substantially octagonal in plan.

9. A portable storage container according to claim 1, in which the first end portion extends to a first arcuate concave edge (11) of said strip (10) and the second end portion extends to a second arcuate concave edge (12) of said strip (10), the radius of curvature of the second concave edge (12) being more than that of the first arcuate concave edge (11).

10. A portable storage container according to claim 1, in which the substantially horizontal elongate members (6) comprise open ended members and in which the upright members (3) are each provided with corresponding stub arms (13), each adapted to be snugly received within a corresponding open ended member (6).

11. A portable storage container according to claim 10, in which the open ended members are secured to corresponding stub arms (13) by means of retaining pins (14) adapted for reception in corresponding aligned bores in the stub arms (13) and in the open ended members.

12. A portable storage container according to claim 11, in which the retaining pins (14) are captive pins.

13. A portable storage container according to claim 10, in which the open ended members comprise hollow box section members.

14. A portable storage container according to claim 1, in which the substantially horizontal elongate members (16) comprise male-ended members and in which the upright members (3) are each provided with corresponding stub arms (13), each provided with a female socket for snug receipt of a corresponding male end of a substantially horizontal elongate member (6).

15. A portable storage container according to claim 14, in which the male-ended members are secured to corresponding stub arms (13) by means of retaining pins (14) adapted for reception in corresponding aligned bores in the stub arms (13) and in the male-ended members.

16. A portable storage container according to claim 1, in which the upright members (3) and the elongate members (6) are articulated to one another so as to permit a limited amount of movement relative to one another in order to accommodate unevenness of any support surface upon which the portable storage container is erected, at least until the flexible vessel (2) is filled.

17. A portable storage container according to claim 16, in which the upright members (3) and the lower cross bars (5) are articulated to one another so as to permit a limited amount of movement relative to one another in order to accommodate unevenness of any support surface upon which the portable storage container is erected, at least until the flexible vessel is filled.

18. A portable storage container according to claim 16, in which the diameter of the inner vessel (2) is selected in relation to the interior dimensions of the support frame (1) so that, during filling of the vessel (2), the internal pressure in the inner vessel (2) due to the contents of the inner vessel (2) causes the upstanding perimetral wall (8) to abut against the lower cross bars (5) thereby to stiffen the support frame (1) and render it essentially rigid.

19. A portable storage container according to claim 1, in which the exterior support frame (1) includes a plurality of lower cross bars (5), each of which extends between an adjacent pair of upright members (3) at a height of from about one quarter to about one half of the way up the height of the upright members (3).

20. A portable storage container according to claim 19, in which the lower cross bars (5) comprise open ended members and in which the upright members (3) are each provided with corresponding stub arms (13), each adapted to be snugly received within a corresponding open ended member.

21. A portable storage container according to claim 19, in which the lower cross bars (5) comprise male-ended members and in which the upright members (3) are each provided with corresponding stub arms (13), each provided with a female socket for snug receipt of a corresponding male end of a substantially horizontal elongate member (5).

22. A portable storage container according to claim 19, in which the lower cross bars (5) each extend between an adjacent pair of upright members (3) at a height of about one third of the way up the height of the upright members (3).

23. A portable storage container according to claim 1, in which the attachment of the second end portion of each strip (10) to the outer face of the perimetral wall (8) is provided with reinforcement means.

24. A portable storage container according to claim 23, in which the reinforcement means comprises a separate gusset of flexible material folded into a V-shape, one arm of the V-shape being secured to the inner face of the strip and the other end being secured to the outer face of the perimetral wall (8).

* * * * *